US008286294B2

(12) United States Patent
Cassar

(10) Patent No.: US 8,286,294 B2
(45) Date of Patent: Oct. 16, 2012

(54) QUICK DISCONNECT SWIVEL CONNECTOR FOR MULTIPLE TOOLS

(76) Inventor: Simon Cassar, Watsonville, CA (US)

( * ) Notice: Subject to any disclaimer, the term of this patent is extended or adjusted under 35 U.S.C. 154(b) by 87 days.

(21) Appl. No.: 12/931,181

(22) Filed: Jan. 26, 2011

(65) Prior Publication Data

US 2011/0203065 A1 Aug. 25, 2011

Related U.S. Application Data

(63) Continuation-in-part of application No. 10/859,714, filed on Jun. 3, 2004, now Pat. No. 7,895,697.

(51) Int. Cl.
*A47L 13/20* (2006.01)

(52) U.S. Cl. ..... 15/144.1; 15/228; 15/229.1; 15/229.6; 15/172

(58) Field of Classification Search ..... 15/144.1, 15/144.2, 228, 229.1–229.9, 172, 147.1
See application file for complete search history.

(56) References Cited

U.S. PATENT DOCUMENTS 1,896,843 A * 2/1933 Hall, Jr. ..... 15/144.1
2,286,655 A * 6/1942 Supnick ..... 403/100
2,704,853 A * 3/1955 Gantz ..... 15/168
3,006,668 A * 10/1961 Stewart ..... 403/68
3,016,556 A * 1/1962 Greenleaf ..... 15/229.8
3,045,271 A * 7/1962 Cinotti ..... 15/235.8
3,051,976 A * 9/1962 Duboiset al. ..... 15/144.2
3,506,996 A * 4/1970 Brennan ..... 15/144.1
4,763,377 A * 8/1988 Madsen ..... 15/144.2
5,207,754 A * 5/1993 Harrah ..... 15/147.1
5,243,729 A * 9/1993 Tomm ..... 15/147.1
5,333,345 A * 8/1994 O'Donnell ..... 15/159.1
5,901,402 A * 5/1999 Williams ..... 15/144.1
6,061,864 A * 5/2000 Ensson ..... 15/147.1
6,237,182 B1 * 5/2001 Cassar ..... 15/144.1
6,279,189 B1 * 8/2001 Cassar ..... 15/144.1
7,574,777 B1 * 8/2009 Fuller et al. ..... 16/436

* cited by examiner

*Primary Examiner* — Shay Karls

(57) ABSTRACT

An adjoined shock absorbing non-breakable two-sectional swivel type attachment in which one section is made from a unitary shock absorbing flexible elastomer material absorbing shocks and allowing for a quick release clamp mechanism and the other section is adjoined by an axis that retains the handle allowing for swivel movement. The combination of the quick release unitary flexible clamp mechanism adjoined to a swivel mechanism allows for small tools, cleaning devices, such as scrub brushes, wall washers, abrasive pad holders, etc. or any other type of device requiring a non-breakable quick disconnect device to occur that can be easily engaged and disengaged allowing tools, etc. to also be used as a hand held device. When the swivel mechanism is in the locked fixed non-swiveling position, the shock absorbing axis and its supporting upper and lower plates, that are retained by a pin, flex and absorbs shocks due to its elastomers flexible properties and eliminates breakage when hitting stationary objects. Furthermore, swivel type floor cleaning devices will no longer need their own swivel type connector affixed onto the cleaning head thus making the cleaning products more cost efficient.

17 Claims, 4 Drawing Sheets

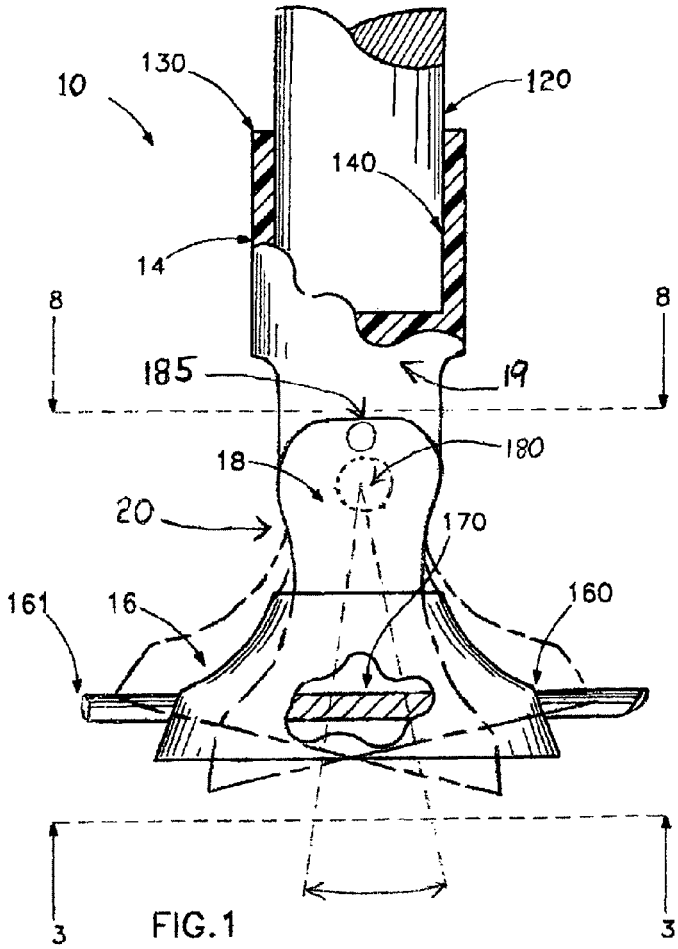
FIG.1
FIG.2
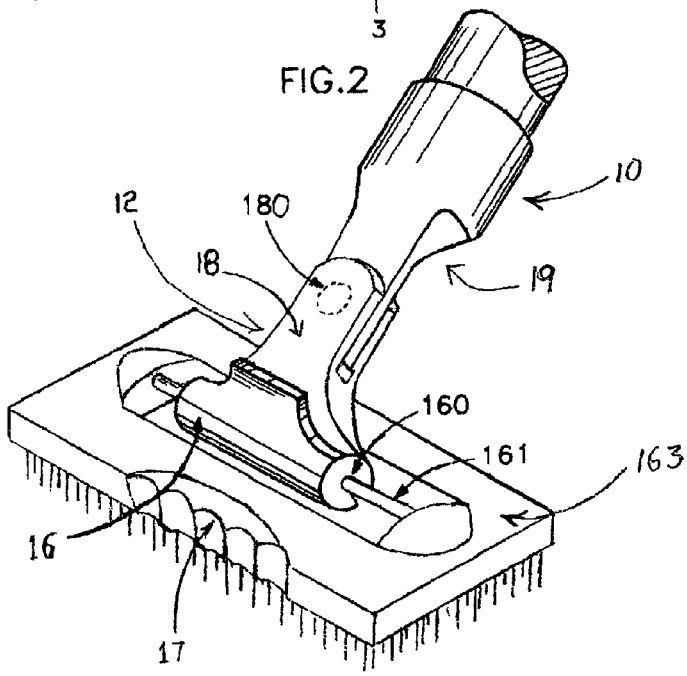
FIG.3
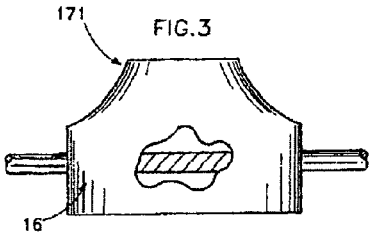

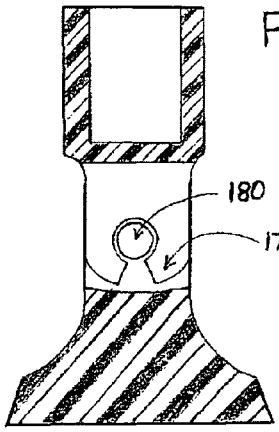
FIG. 10
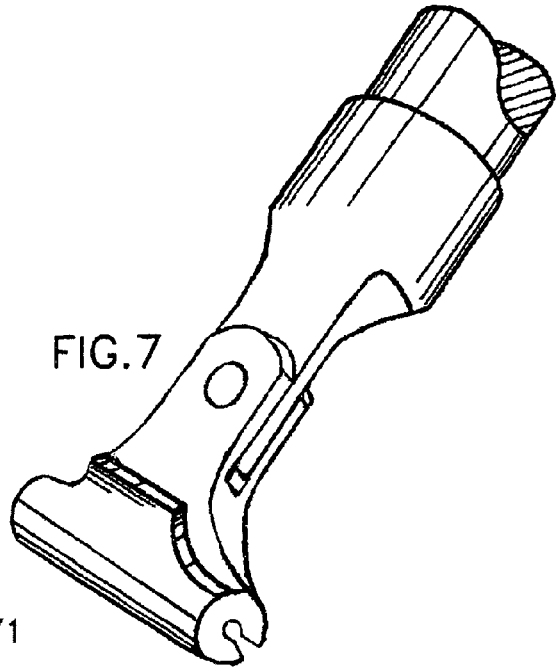
FIG. 7
FIG. 8
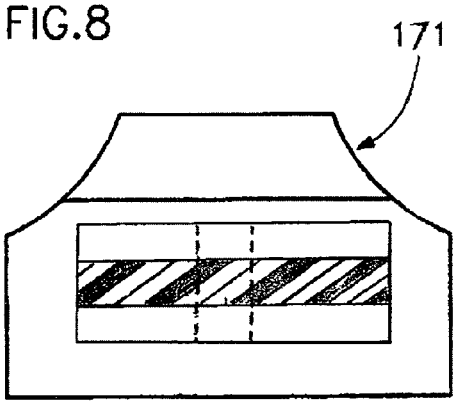
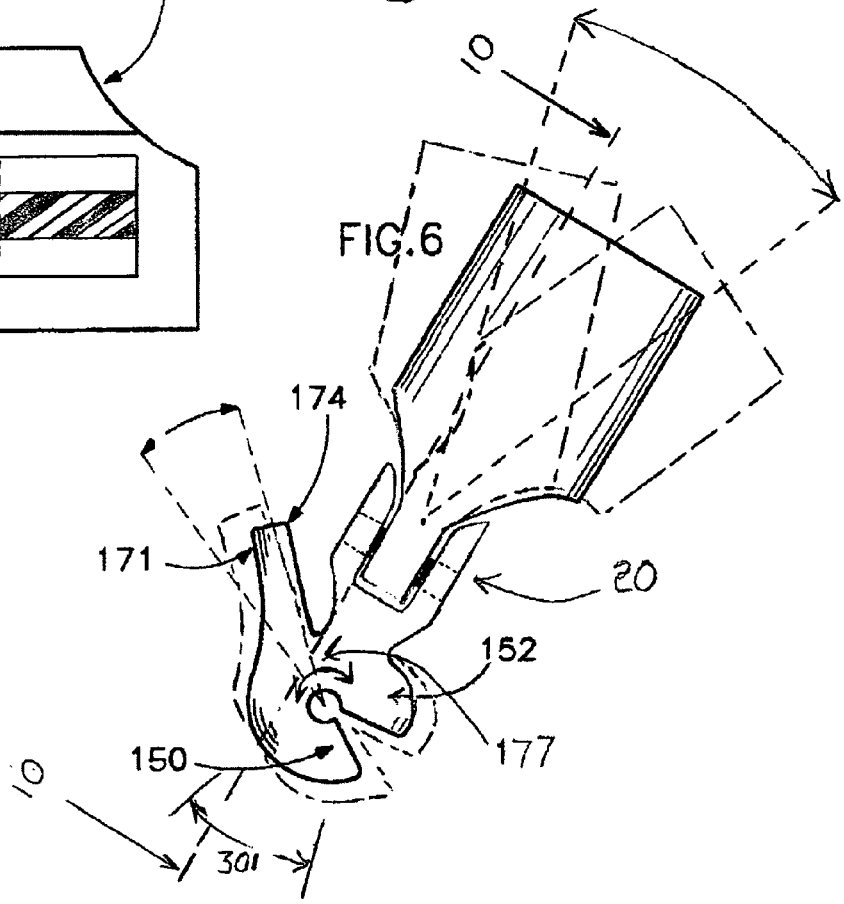
FIG. 6

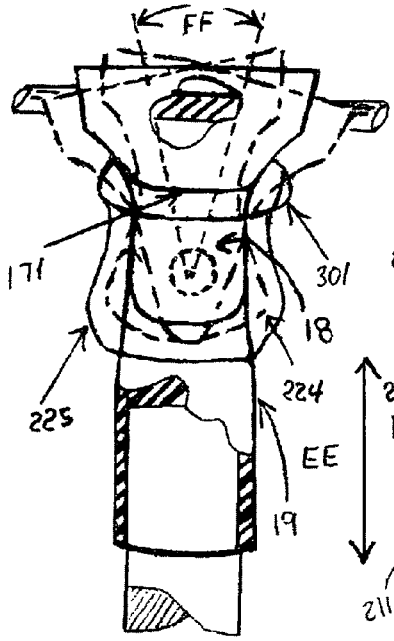
Figure 16
Figure 15
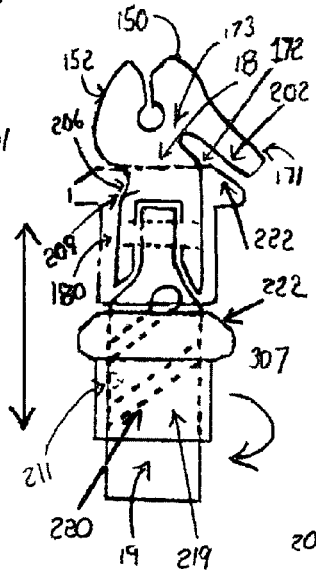
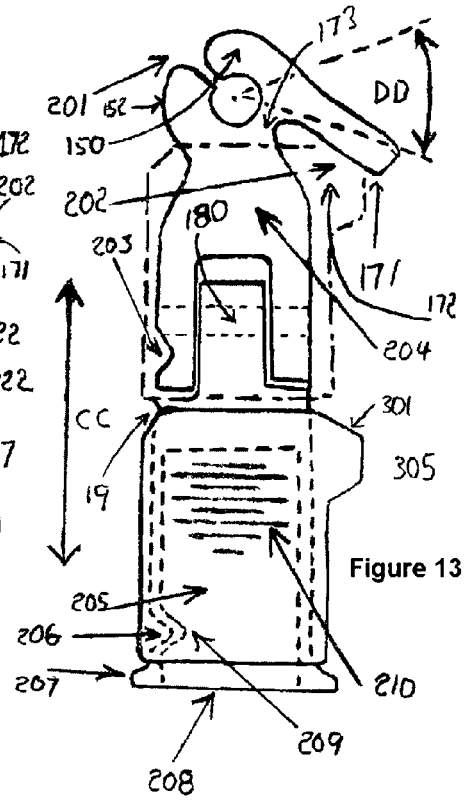
Figure 13
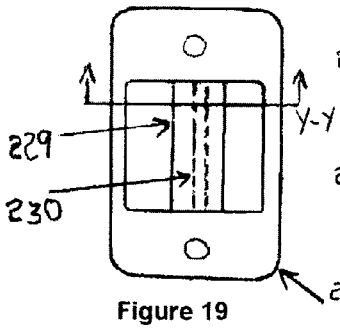
Figure 19
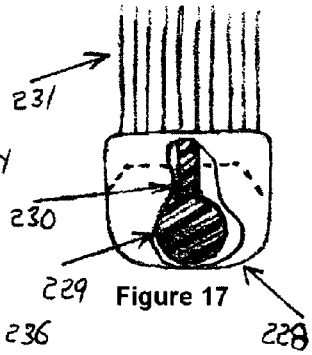
Figure 17
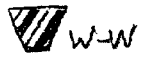
FIG.22
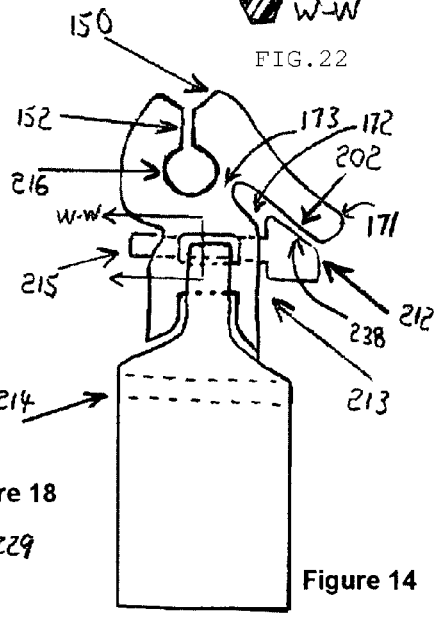
Figure 14
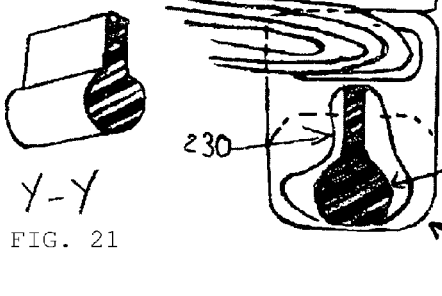
Figure 18
Y-Y
FIG. 21

QUICK DISCONNECT SWIVEL CONNECTOR FOR MULTIPLE TOOLS

The application is a continuation in part of application Ser. No. 10/859,714, now U.S. Pat. No. 7,895,697, filed Jun. 3, 2004.

BACKGROUND OF THE INVENTION

1. Background of the Invention

The present invention relates to attaching any type of tool that when abused flexes and absorbs shocks thus making it unbreakable. In particular products that take harsh abuse like cleaning tools for scrubbing, dust mopping, or a sweeping apparatus and in particular to scrub brushes or applications where material is being removed by an apparatus. The present invention relates to a swivel joint two piece unitary flexible molded elastomer attachment that allows multiple cleaning apparatuses to be attached and detached for cleaning purposes. The new innovation allows for easy engagement and disengagement of the swivel mechanism to the cleaning head apparatus thus eliminating costly swivel joints that are adjoined to prior art swivel joint type cleaning apparatuses. In addition, the swivel type cleaning head apparatuses can be used as a hand held cleaning apparatus when not engaged with the swivel type joint quick release mechanism. In addition, using an elastomer material for the shock absorbing symmetrical jaws that encompasses the swivel axis allows for the jaws to be preloaded thus the swivel does not become loose.

2. Description of Prior Art

The standard swivel type floor cleaning apparatus has two primary components. The first component is the floor cleaning head such as a flat mop, dust mops, wall washer, grout cleaner, scrub brush, abrasive pad holder. All these floor-cleaning apparatuses have an adjoined embodied swivel type connector that is permanently attached to the cleaning apparatus making them very costly. The second primary component of floor cleaning apparatuses is the handle which is usually a cylindrical pole that is inserted into the swivel joint handle connector. The floor handle connector is only removable by unthreading the lock nut or twisting the handle out of the handle connector leaving the swivel joint mechanism attached to the cleaning apparatus. The combination of the unitary elastomer quick disconnect and rotating swivel type mechanism permits all floor cleaning apparatuses to be pushed and pulled by exertion of a force on the handle and flex to absorb damaging impacts when coming in contact with obstacles. Prior art has also addressed the issue of loose swivels as in U.S. Pat. No. 4,763,377

One significant problem with swivel type floor cleaning apparatuses is the swivel type apparatus eventually breaks around the swivel type axis and/or upper and lower support members supporting the axis when either hitting stationary objects or abuse. Also, when the swivel type axis is jammed or locked into a non-swiveling static position allowing only one position to be retained, the leverage caused by the jam/stop causes swivel type attachments caused the swivel type connectors to break. This new innovation is made from shock absorbing flexible elastomer material that can absorb abusive shocks. The leverage caused by the impact of hitting stationary objects causes non-shock absorbing jaws, upper and lower support members and axis to easily break when hitting stationary object. Also swivel joints that are used to adjoin a cleaning apparatuses like scrub brushes, wall cleaning, abrasive pad holders, flat wet mops and small dust mops are attached to the cleaning apparatus making the cleaning apparatus costly to manufacture. Such is the case in prior art U.S. Pat. No. 4,763,377. Also, the cleaning apparatus can only be used for floor cleaning due to the large swivel joint adjoined to the cleaning apparatus. Prior art such as "Flexible Elastomer Floor Dust Mop Attachment", U.S. Pat. No. 6,237,182 does allow for easy disengagement and does preload the axis due to the elastomer material wrapping around the axis, but due to its flexible joint between the clamp and the handle connector, verses a swivel type joint, the flexible member does not allow for small cleaning device such as scrub brushes and other small cleaning apparatuses to lay flat on the ground during the cleaning operation and instead part of the scrub brush is lifted up when the flexible joint is pivoted. Simply put, the flexible joint acts as a spring action causing the floor cleaning apparatus to lift up on the opposing side of the pivoting action. On large dust mops this is not so evident, but on smaller cleaning apparatuses such as a scrub brush, wall washers and small dust mop frames this is unfortunately extremely apparent. Also, the flexible one piece joint cannot allow for the swivel movement to become fixed and not swivel or flex when cleaning areas that do not require the cleaning apparatus to swivel but instead to remain stationary. However, the present invention allows for the swivel movement to be jam/stop by the use of a jam pin and/or locking slider containment housing, thus stopping the swivel movement and keeping the cleaning head in one locked position yet flexes when abused. Other disengagement type swivel joints like Large dust mop frames do have disconnecting swivel joints like U.S. Pat. No. 5,901,402 but due to the large size of the connector, multiple parts causing looseness when attached to a small cleaning device they are not functional. Also, prior art U.S. Pat. No. 4,763,377 prevents loose swivels but is not as cost effective as the present invention due to the swivel joint being attached directly to the cleaning apparatus so when the brush is worn both the brush and swivel joint is discarded thus making the product more costly that a reusable swivel joint that can be used on other cleaning apparatuses. Thus the innovative cleaning swivel joint comprises of a cleaning head connected to a two piece unitary flexible shock absorbing unbreakable molded elastomeric swivel joint, the cleaning head has a top mounting surface and a bottom cleaning surface, the top mounting surface has a support frame extending along the longitudinal axis of the head; the two piece swivel joint comprises a lower support member and an upper support member, the lower support member has a first end and a second end, the first end of the lower support member comprises a unitary flexible transverse clamping section having an upper jaw and a lower jaw that forms an elastomeric hinge that is made from a compressible expandable elastomer material to allow preload gripping force thus encapsulating the said support bar. Therefore, a significant need exists to improve upon the previous patents that allows for a shock absorbing elastomeric flexible swivel connector that when abused or placed in a fixed non swiveling position flexes and absorbs shocks thus eliminating breakage and negotiates around obstacles that would of otherwise break or damaged the handle or swivel type handle connector. Also, the new innovation allows for a more cost effective non-loosening swivel type floor connector that can be easily detached from multiple cleaning devices thus allowing the cleaning apparatus to also be used for hand operations thus reducing cost, space and increasing durability.

SUMMARY OF THE PRESENT INVENTION

The present invention is a shock absorbing unbreakable swivel type apparatus that is affixed at The location between a handle and head of the floor cleaning apparatus to provide a flexible member at the junction where the floor cleaning handle apparatus is attached to the floor cleaning apparatus head. One significant problem is swivel type apparatuses eventually break around the swivel type axis and/or upper and lower support structure supporting the axis. Also, when the swivel type axis is jammed or in a locked non-swiveling position allow only one position to be retained, the leverage caused by the swivel mechanism being locked or jammed causes non-shock absorbing jaws, upper and/or lower members around rotating axis or axis shaft/pin and its surrounding area to easily break when the floor cleaning apparatus head comes in contact with a stationary object. The new innovation swivel joint apparatus will flex approximately 3-75 degrees deflection in the lateral and/or vertical axis and also the longitudinal axis in relation to the floor cleaning apparatus. A swivel cleaning attachment wherein said clamping member rotates around said axis member shock absorbing axis member and adjoined symmetrical jaws that can be jammed to stop the swiveling motion by way of a pin inserted between said clamping member and said shock absorbing symmetrical jaws and axis member to eliminate breakage when hitting stationary objects thus allows the handle to negotiate around such objects into the two scissor like members when in the free rotational swivel position the pin can stored in the upper portion of the connector or handle that does not interfere with the swivel movement. It is therefore an object of the present invention to provide an unbreakable flexible shock absorbing swivel type apparatus that can easily disengage and engaged from tools that can also be locked into position without rotating thus also being made from a flexible material that can absorb damaging impacts when abused. Also, the new innovation allows all tools to be able to be held by hand since the apparatus is positioned permanently on the handle and no on the tool itself thus allowing the apparatus to cost less to manufacture than standard swivel type connectors.

Further novel features and other objects of the present invention will become apparent from the following detailed description, discussion and the appended claim, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the preferred embodiment of the present invention floor cleaning handle apparatus attached to the floor scrub brush of the preferred embodiment of the present invention floor cleaning handle apparatus illustrating the flexing movement of the attachment when in the fixed locked static position and in contact with a stationary object.

FIG. 2 is a perspective view of the preferred embodiment of the present invention floor-cleaning handle apparatus attached to the floor scrub brush.

FIG. 3 is a cross-sectional view looking up taken along line 3-3 of FIG. 1.

FIG. 4 is a front elevational view of the preferred embodiment of the present invention floor cleaning handle apparatus illustrating the movement of the attachment when in contact with a stationary object.

FIG. 5 is a side elevational view of the preferred embodiment of the present invention floor cleaning handle apparatus.

FIG. 6 is a side elevational view of the preferred embodiment of the present invention floor cleaning handle apparatus illustrating the movement of the elastomer hinge allowing an opening for the floor cleaning apparatus support frame to be attached. Also shown is the flexing movement of the connector when being abused like being stepped on.

FIG. 7 is an isometric view of the floor cleaning handle apparatus in its entirety.

FIG. 8 is a cross-sectional view looking down taken along line 8-8 of FIG. 1.

FIG. 9 is an isometric view of the floor cleaning handle alternate attachment in its entirety.

FIG. 10 Is a cross-sectional view looking down taken along line 10-10 of FIG. 6.

FIG. 11 Is a perspective view of the jaw clamp preloaded onto the rotating shaft axis.

FIG. 12 Is a perspective view of the jaw clamp alternative preloaded onto the rotating shaft axis.

FIG. 13 Is a side elevational view is an alternate embodiment of the present invention floor cleaning handle apparatus.

FIG. 14 Is a side elevational view of an alternate embodiment to locking the swivel movement.

FIG. 15 Is a side elevational view of an alternate embodiment to locking the swivel movement with a rotating housing.

FIG. 16 Is a front elevational view of an alternate embodiment of the present invention floor cleaning handle apparatus illustrating the flexing movement of the attachment when in the fixed locked static position and in contact with a stationary object.

FIG. 17 Is a side elevational view of the fix joint attachment shaft for the preferred embodiment mounting shaft attached to bristled lobby brush.

FIG. 18 Is a side elevational view of the fix joint attachment shaft for the preferred embodiment mounting shaft attached to string wet mop.

FIG. 19 Is a perspective view of the preferred embodiment of the present invention mounting shaft looking top down.

FIG. 21 is an enlarged view of Y-Y in FIG. 19.

FIG. 22 is an enlarged view of W-W in FIG. 14.

DETAILED DESCRIPTION OF THE PREFERRED EMBODIMENT

Figure 20:
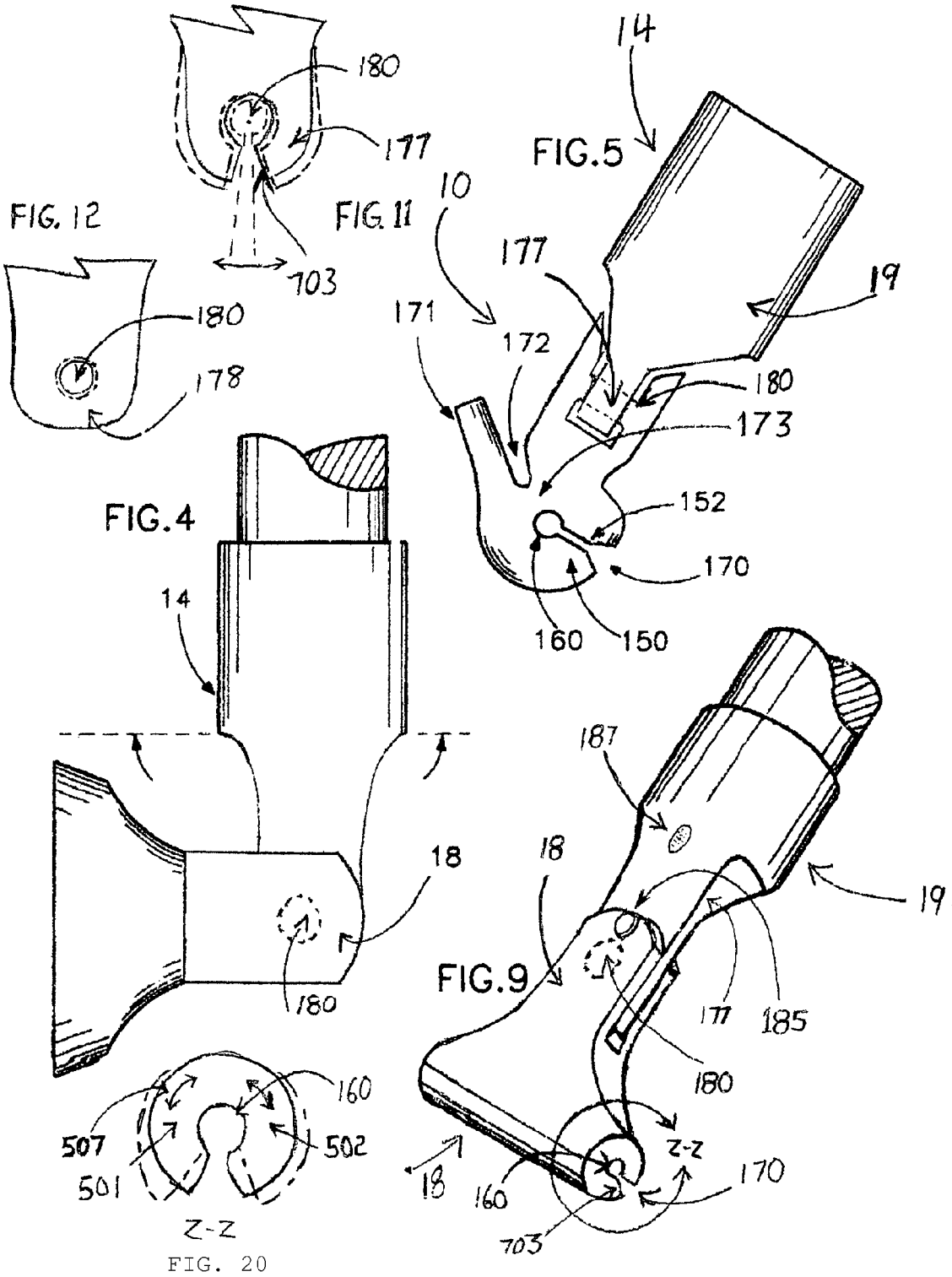
FIG. 20 is an enlarged view of Z-Z in FIG. 9.

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

In the preferred embodiment, the insert member 10 in FIG. 1 is made of any flexible substance with memory such as rubber, urethane, nylon, plastic, titanium, polyvinyl. It is also within the spirit and scope of the present invention for the attachment to be made of flexible but strong plastic such as mylar, polypropylene or any other flexible material exhibiting the required shock absorbing flexible characteristics.

Referring to FIG. 1, there is shown at 10 the present invention swivel connector for multiple cleaning apparatuses. The apparatus is made from an elastomeric material comprised of two pieces upper support member 19 and lower support member 18 joined together at the rotating axis 180.

Lower support member 18 is made from an elastomeric flexible material with sufficient memory to retain support bar 161. When upper support member 19 and lower support member 18 is locked around axis 180, thus not allowing the apparatus to rotate and instead be locked into a fixed one position, either and/or both upper support member 19 and/or lower support member 18 is made from a flexible shock absorbing elastomeric material thus allowing the approximate mid section 20 to bend or flex allowing lateral flexing of longitudinal section and handle member between the range of approximately 3.degree.-75.degree when being abused or hitting a stationary object thus eliminating damage to obstacles or apparatus or handle breakage; whereby shock absorbing flexible mid section allows handle member to maneuver said head member to be pushed back and forth while at the same time allows said handle member to move laterally relative to said head member and when said head member comes in contact with an object thereby prevents said handle member from lateral movement such that said flexible insert member prevents said handle member from damaging obstacles or cleaning head apparatus. Thus shown is clamp mechanism 16 and support frame 161 with Support pin 185 is engaged stopping rotation and showing the connector flexing around the lateral axis in the approximate mid section 20 or when support pin is not engaged to rotate beyond full 180 degrees deflection to negotiate around obstacles. Phantom lines illustrating the flexing movement allowing the connector be become shock absorbing can be seen with pin 185 engaged.

It should be noted that the rotating axis is not limited to the type of axis used. For example the rotating axis member 180 could be an integrally unitary molded shaft that makes up the lower support member 18 or could be a bolt, pin, rivet, fastener etc. In the preferred molded embodiment, the apparatus 10 comprises a longitudinal section 14 and a lateral section 16 that are interconnected by axis 180 as shown in cross sectional view FIG. 10. In general appearance, the two-piece molded inserts looks like an extended Roman numeral one with the top portion, item 130 being the receptacle to hold the handle 120. The handle is supported by the attachment body 14 that is a recessed cavity to hold the floor handle. Accordingly the upper sleeve portion of the cylindrical sleeve section 130 includes an axial bore 140 having a uniform dimension so as to receive therein the transverse dimension of the handle 120. The thickness of the material-encapsulating handle 120 is sufficient to not crack when impact to the head of the floor cleaning apparatus occurs. The upper sleeve section 130 has a diameter to tightly receive in a generally slip-fit relationship the transverse dimension of the handle to frictionally retain the handle therein. It is not limited to the intent of this invention as to how the handle is retained and can be either threaded or attached by a bolt or rivet. The overall configuration of the lower support member 18 as it joins to the floor cleaning apparatus frame support clamp recess cavity 160 resembles an inverted "T" with the mid portion of the vertical leg being thin in the middle and the lower portion of the leg extending outboard in both the left and right lateral directions to form the clamp mechanism 16 as shown in FIG. 1. The clamp mechanism 16 when attached to the floor cleaning head support frame 170 retains the floor cleaning apparatus head.

Referring to FIG. 2, there is illustrated in a perspective view the relationship between the perspective floor cleaning brush head 163 and floor cleaning handle attachment 10. The present invention includes a two sectional connector adjoined together through axis shaft 180. The lower support member 18 comprising of a clamping mechanism section and an upper support member 19 comprising of the handle support hole. Both sections are a one piece unitary molded part adjoined only be way of axis 180. The floor cleaning brush head support frame 161 is encapsulated by the clamp mechanism 16 and supported by the lateral recess cavity 160. The support frame 161 has an approximate diameter between 0.25 to 0.50 of an inch. The larger diameter allows for the cleaning head to be a unitary one piece injected molded apparatus. The lower support member 18 adjoins the clamp mechanism 16. When the clamp mechanism 16 is disengaged from the support frame 170 the cleaning brush head 163 or cleaning head devices can be used as a hand held cleaning device using ergonomic hand hold 17.

Referring to FIG. 3. Illustrates the clamp mechanism 16 and the protruding push lever 171 that allows leverage to open the jaws of the clamp.

Referring to FIG. 4. Illustrates the movement of the swivel connector when in contact with a stationary object in the non-locked fixed position. The floor cleaning attachments lower support member 18 can rotate around the axis shaft 180 over 90 degrees in relation to the floor cleaning handle support 14. The reason for over 90 degrees is due to its flexible shock absorbing elastomer material.

Referring to FIG. 5. there is Illustrates the unitary elastomeric clamp mechanism. The elastomer hinge clamp mechanism 160 has an upper jaw 152 and lower jaw 150 with an opening slotted jaw 170 that extends laterally. Opening 170 allows for access to retaining cavity 160 that encapsulates firmly but loosely supports the floor dust mop frame in order to pivot along the lateral axis. The upper clamp 152 remains rigid while the lower clamp 150 pivots around the lateral axis at cavity 172. Protruded lever 171 when depressed displaces cavity 172 allowing for lower clamp 150 to move forward in relation to upper clamp 152 allowing for opening 170 to enlarge as shown in FIG. 6. elastomer hinge 173 allows for a preload to occur around the clamping mechanism and can be opened by compressing and expanding the flexible elastomer material in the elastomer hinge. The peripheral side arm type jaws 177, wrap around the axis shaft 180.

Referring to FIG. 6. There is Illustrates the elastomeric connector with phantom lines illustrating the flexing movement around the horizontal axis in the approximate mid section 20 when being either pushed down on the handle or pulled up excessively by exertion of a force thus the shock absorbing flexing of the approximate mid section 20 prevents said handle member, swivel attachment, and/or floor cleaning apparatuses from being damaged thus becoming unbreakable. The flexible shock absorbing elastomeric material thus allows the approximate mid section 20 to bend or flex allowing horizontal flexing of longitudinal and handle member between the range of approximately 3.degree.-75.degree item 301 when being abused or hitting a stationary object thus eliminating damage to obstacles or apparatus or handle breakage; whereby shock absorbing flexible mid section 20 allows handle member to retain sufficient stiffness but when excessive downward force is applied the said mid section 20 will flex and absorb the shock when a force is applied by a downward force thereby prevents said handle apparatus and/or handle from damage. There is Illustrated the movement of the elastomer hinge clamp mechanism between upper and lower clamps 150 and 152 when force is applied to protruded lever 171 on side 174 causing expansion and compression on elastomer hinge 177.

Referring to FIG. 7. there is an isometric illustration of the attachment in its entirety.

Referring to FIG. 8. there is Illustrated a cross sectional view with the flexible elastomeric material shaped as a rectangle. The purpose of a rectangular shape is to allow for maximum flexibility in the lateral movement yet retains rigidity in the forward and aft movement.

Referring to FIG. 9. there is shown an isometric illustration of an alternate embodiment of present invention without the protruding lever to ease in opening the clamp in its entirety. Also shown is jam pin 185 inserted into lower support member 18 and arm type jaws 177 to jam/stop the rotation of the swivel joint around axis 180. Storage hole 187 is shown that would house the jam pin 185 when normal swivel movement of the connector is required. This alternative embodiment is identical for attaching the base of the apparatus to a floor cleaning device support frame that is illustrated in FIG. 9. The alternate attachment is identical to the previous attachment described except has no protruding lever 171. However, there is still the open recessed cavity 170 as depicted in FIG. 5 that allows for ease of installing the attachment onto the floor cleaning apparatus frame. To install the alternate embodiment, the operator must apply force to press on the attachment onto the floor dust mop frame. Due to its obvious nature of the design for easy insertion onto the support bar without the use of a protruding lever to open the symmetrical jaws, the opening can be either and/or have a radius and/or bevel to the opening of the peripheral symmetrical side arm type jaws to allow for easy insertion onto the retaining bar. This obvious nature to a beveled and/or radius angled front face to the symmetrical jaws to allow easy engagement to the attachment bar is shown in original submission for the axis pin in FIG. 10 with the peripheral symmetrical side arm type jaws 177 being beveled. The front face of the peripheral symmetrical arm type jaws front face 703 are either beveled or and/or radius for easy insertion onto support bar. In blow up view Z-Z (FIG. 20) the elastomer hinges 501 and 502 that encapsulate retaining cavity 160 that holds the support bar shows the expansion and compression of the elastomer hinge 507 with phantom lines when the apparatus is being pushed by force onto the retaining bar thus allowing for insertion of the apparatus onto the support frame and being retained within retaining cavity 160. It should be noted that either and/or both of the elastomer hinges can be used to open up to allow access to retaining cavity 160 that encapsulates the support bar and retains the apparatus.

Referring to FIG. 10. there is Illustrated a cross sectional view of the attachment in its entirety, The peripheral symmetrical side arm type jaws 177, preloaded and wrapped around the unitary elastomer expandable axis shaft 180.

Referring to FIG. 11. there is illustrated a section view of the peripheral symmetrical arm type jaws 177 revealing the preload movement once inserted onto the expandable elastomer axis shaft 180. The front face of the peripheral symmetrical arm type jaws front face 703 are either beveled or and/or radius. The preloaded jaws 177 around expandable elastomer shaft 180 eliminates wobble and excessive movement of the cleaning head during a cleaning operation. Clearly shown, is the beveled openings of the peripheral symmetrical arms to allow easy insertion onto the axis pin 180.

Referring to FIG. 12. there is illustrated an alternate embodiment 178 that encapsulates axis shaft 180. The axis shaft hole size for shaft 180 will be undersized and the flexible elastomer material that has expansion and compression properties can be adjusted via a threaded bolt and wing nut to adjust the amount of pre-load causing friction to eliminate wobble during a cleaning operation. This method would allow for a pin, fastener or bolt to attach the upper and lower members together.

Referring to FIG. 13. there is illustrated an alternate embodiment 305 that encompasses a flexible elastomer and/or metalic locking slider containment housing 205 that encapsulates and slides up and down the lower support member 18 and upper support member 19 thus slides forward and aft over the upper and lower support members. The locking slider containment housing 205 is a rectangular shaped hollow apparatus with two open ends to allow for the swivel cleaning apparatus to be inserted into. When the locking slider containment housing 205 is in the deployed position, as shown via phantom lines, the slider containment housing encapsulates both the upper support member 19 and lower support member 18 thus causing the upper and lower support members to not rotate around shaft 180 thus locking the apparatus into a fixed non-rotating position. This same non-rotating position also locks elastomer hinge 173 from inadvertently opening up when frontal hinge stop 301 makes contact with back side of protruded lever 202 on protruding lever 171 and displaces cavity 172 with hinge stop 301 thus stopping lower clamp 150 to move forward in relation to upper clamp 152 and stopping the elastomer hinge 173 from opening up inadvertently when attached to example heavy mops, lobby brooms or any other type of heavy objects and/or that require a non-rotating support bar therefore requiring a protruding keyed support bar as shown in FIG. 17 on lobby type brooms or other objects. When the locking slider containment housing 205 is in the stowed or deployed position it is held in place by any type of protruding members or cavities such as protruding gripper 206 and gripper recess cavities 209 and 203 that support and holds in place the locking slider containment housing 205 from inadvertently sliding to either and/or the stowed or deployed position during operation. Aft protruding limit stop 207 eliminates any potential movement of slider going past the upper support member 19 and falling off the upper support member 19. Locking slider containment housing 205 has slight or large protrusions grippers 210 for ease of holding Locking slider containment housing 205 when moving from deployed or stowed position. Axial bore hole opening 208 for a handle with leverage is shown.

Referring to FIG. 14. there is illustrated an alternate embodiment of the non-swiveling position using lock pin 212 that also locks elastomer hinge 173 from inadvertently opening up when lock pin frontal face 238 makes contact with back side of protruded lever 202 on protruding lever 171 and displaces cavity 172 with lock pin 212 thus stopping lower clamp 150 to move forward in relation to upper clamp 152 stopping the elastomer hinge 173 from opening up inadvertently when attached to heavy mops, lobby brooms or any other type of heavy objects and/or that require a non-rotating support bar therefore requiring a protruding keyed support bar as shown in FIG. 17 on lobby type brooms or other objects. The shape of the lock pin 212 frontal face is not limited to size and shape and the cross sectional pin shaft 215 can be rectangular, square or round and not limited to type of shape. The pin 215 cross sectional shape is a isosceles trapezoid W-W (FIG. 22) to ensure when the pin is inserted into the upper and lower support members to lock the apparatus into a fixed position the pin 215 can be installed only one way thus ensuring the protruding face 238 makes contact with back side of protruded lever 202.

Referring to FIG. 15. there is illustrated an alternate embodiment 307 that encompasses a flexible and/or hard elastomer locking cylindrical threaded slider containment housing 219 that has internal threads and when rotated either clock wise or counter clockwise depending on the thread configuration when twisted travels up to encapsulate the upper support member 19 and lower support member 18 that has external threads that engage and track the locking cylindrical threaded slider housing internal threads thus when twisted encapsulates both the upper and lower members thus stopping rotation around axis pin 180, when rotated counter clockwise or clockwise depending on design configuration, rotates down to the stowed position on the upper support member 19. The locking cylindrical threaded slider containment housing 219 is a cylindrical shaped tube that has internal threads 220 and open ended on both sides and when twisted travels up the upper support member 18 to engage the back side of protruding lever 171 with cylindrical hinge lock shoulder 222. The hollow tube shape allows for the swivel cleaning apparatus to be inserted into. The threads on both the upper 19 and lower 18 support members allows the locking cylindrical threaded slider containment housing 219 to move up and down. When the locking cylindrical slider containment housing 219 is in the deployed position, as shown via phantom lines, encapsulates both the upper support member 19 and lower support member 18 the two upper and lower support members cannot rotate around shaft 180 thus locking the apparatus into a fixed non-rotating position. This same non-swiveling position also locks elastomer hinge 173 from inadvertently opening up when frontal cylindrical hinge lock 222 makes contact with back side of protruded lever 202 on protruding lever 171 and displaces cavity 172 with cylindrical hinge lock 222 thus stopping lower clamp 150 to move forward in relation to upper clamp 152 stopping the elastomer hinge 173 from opening up inadvertently when attached to tools, heavy mops, lobby brooms or heavy objects. It should be noted that this application of stopping the lever from opening up by way of interfering with the lever by displacing cavity 172 is not limited and that any device with mass, such as a pin, bolt, or a sliding protruding mass, that can be pushed to make contact with the back side of lever 202 via encapsulating tracks on lower support member 118 and/or any other means to limit the movement of lever 171 and yet allow full rotation of the lower support member 18 and upper support 19 around axis 180. Also, the same is for a non-rotating support bar therefore requiring a protruding keyed support bar as shown in FIG. 17 on tools, lobby type brooms and other devices that apply to stopping the lever from opening up by way of interfering with the lever by displacing cavity 172 is not limited and that any device with mass, such as a pin head, bolt head, or a sliding protruding mass, that can be pushed to make contact with the back side of lever 202 via encapsulating tracks on lower support member 118 and/or any other means to limit the movement of lever 171 and yet allow full rotation of the lower support member 18 and upper support 19 around axis 180. In any of the sliding type lever stops are used they are not limited to protruding grippers and/or cavities to limit the movement of the mass to ensure they do not disengage inadvertently when either in contact with the back side of the lever 202 or the protruding lever 171 is pushed down to open jaws 152 and 150 to allow access to engage support bar.

When the locking round slider containment housing 219 is in the stowed or deployed position it is held in place by any type of protruding members or cavities such as protruding gripper 206 and gripper recess cavities 209 and 211 that support and holds in place the locking round slider containment housing 219 from inadvertently twisting to either and for the stowed or deployed position during operation.

Referring to FIG. 16. there is illustrated the alternate embodiments with either type of alternate containment housing 225 flexing and absorbing shock causing the aft end of the lower support member 18 to extend or protrude out making contact and pushing the containment housing causing the containment housing to flex and/or bulge 224 outwards thus stopping rotation of the upper 19 and lower 18 support members yet allowing lateral flexing of longitudinal section and handle member between the range of approximately 3.degree.-75.degree when being abused or hitting a stationary object thus eliminating damage to obstacles or apparatus or handle breakage; whereby shock absorbing flexible containment housing 225 allows handle member to maneuver said head member to be pushed back and forth while at the same time allows said handle member to move laterally relative to said head member and when said head member comes in contact with an object thereby prevents said handle member from lateral movement such that said flexible insert member prevents said handle member from damaging obstacles or cleaning head apparatus. It should be noted, that the containment housing can also be made from strong material like aluminum, acetal plastic or any other minimal flexing material and that the shock absorbing flexing movement will instead occur in the flexible shock absorbing elastomer lower support member 18 and/or flexible shock absorbing symmetrical jaws as shown in FIG. 1.

Referring to FIG. 17. there is illustrated a cross sectional view of the non-rotating support bar 229 with protruding lock key 230 that attaches to the disclosed engagement and disengagement swivel apparatus. When engaged with the swivel apparatus the protruding keyed lever engages the upper clamp and lower clamp opening thus stops the rotation around the non-rotating support bar 229. The application shown is a lobby broom with bristles 231 shown but is not limited to any type of object requiring this type of innovation and the non-rotating support bar can be made from any hard or flexible materials such as steel, titanium, acetal plastics, urethane, etc.

Referring to FIG. 18. there is illustrated a cross sectional view of the non-rotating support bar 229 with protruding lock key 230 that attaches to the disclosed swivel apparatus for a wet mop application with sponge 234 and mop strands 235.

Referring to FIG. 19. there is illustrated view looking down on the non-rotating support bar 229 and housing bracket 236. When in use and operation the non-rotating support bar 229 with said protruding lock key 230 is encapsulated by said upper and lower jaws thus stopping rotation around the support bar. View Y-Y (FIG. 21) is a cross sectional view of the non-rotating support bar in an isometric view.

What I claim as my invention is:

1. A floor cleaning apparatus comprising:

a cleaning head connected to a two piece unitary flexible shock absorbing unbreakable molded elastomeric swivel joint;

a. the cleaning head has a top mounting surface and a bottom cleaning surface, the top mounting surface has a support frame extending along the longitudinal axis of the head;

b. the two piece swivel joint comprises a lower support member and an upper support member, the lower support member has a first end and a second end, the first end of the lower support member comprises a unitary flexible transverse clamping section having an upper jaw and a lower jaw which forms an elastomeric hinge that is made from a compressible expandable elastomer material to allow preload gripping force thus encapsulating the support frame, the upper and lower jaws form a slotted opening which interconnects with a retaining cavity for receiving the support frame of the cleaning head, the lower jaw has a push lever integrally formed therewith, such that when the push lever is forced inwardly, the lower jaw is moved away from the upper jaw for allowing the support frame to be inserted through the slotted opening and secured within the retaining cavity when the push lever is released; and the upper support member has a first end and a second end, the first end of the upper support member has a longitudinal attachment section having an axial bore with an open end to receive a longitudinal handle, the handle has one end press fitted from the open end and secured within the axis bore of the upper support member, the second ends of the lower support member and the upper support member are connected via a pivoting member forming a universal joint, to allow for rotation around a lateral axis, the upper and lower support members are made from an elastomeric flexible material so that when the cleaning apparatus comes in contact with stationary objects or is abused, the two piece unitary swivel joint will flex and prevent damage to the handle, cleaning head and joint.

2. The floor cleaning apparatus of claim 1 further comprising a pin that can be positioned in the second end of the lower member and the second end of the upper member to lock the two piece swivel joint in place, to prevent swiveling around the lateral axis, however still allowing for some flexing due to the flexible material nature of the swivel joint when the cleaning apparatus comes in contact with stationary objects to prevent breakage.

3. The floor cleaning apparatus in accordance with claim 1 wherein said either and/or upper or lower support members are made out of a flexible plastic material with memory.

4. The floor cleaning apparatus in accordance with claim 1 wherein said pin to lock swivel joint can be stored in a storage hole when normal swivel movement of the connector is required.

5. The floor cleaning apparatus in accordance with claim 1 wherein said either and/or upper or lower support members is made out of a elastomer plastic material.

6. A floor cleaning apparatus comprising:

a cleaning head connected to a two piece unitary flexible molded elastomeric swivel joint;

a. the cleaning head has a top mounting surface and a bottom cleaning surface, the top mounting surface has a support frame extending along the longitudinal axis of the head;

b. the two piece swivel joint comprises a lower support member and an upper support member, the lower support member has a first end and a second end, the first end of the lower support member comprises a unitary flexible transverse clamping section having an upper jaw and a lower jaw, the upper and lower jaws form a slotted opening which interconnects with a retaining cavity for receiving the support frame of the cleaning head, means for forcing either one of said upper and lower jaws away from the other one of said upper and lower jaws for allowing said support frame of said cleaning head to be inserted through said opening and secured with said retaining means; the opening can have a radius and/or a bevel to allow for easy insertion onto the support frame; the jaws that encapsulate the retaining cavity, which hold the support frame, expand and compress making an elastomer hinge, one or both of the jaws can be opened up to allow access to the retaining cavity that encapsulates the support frame to retain the cleaning head; that encapsulate said retaining cavity that holds said support bar expand and compress making an elastomer hinge, either and/or both of the elastomer hinges can be used to open up to allow access to said retaining cavity that encapsulates said support bar and retains the apparatus;

c. and the upper support member has a first end and a second end, the first end of the upper support member has a longitudinal attachment section having an axial bore with an open end to receive a longitudinal handle, the handle has one end press fitted from the open end and secured within the axis bore of the upper support member, the second ends of the lower support member and the upper support member are connected via a pivoting member forming a universal joint, to allow for rotation around a lateral axis, the upper and lower support members are made from an elastomeric flexible material so that when the cleaning apparatus comes in contact with stationary objects or is abused, the two piece unitary swivel joint will flex and prevent damage to the handle, cleaning head and joint.

7. The floor cleaning apparatus of claim 6 further comprising a pin that can be positioned in the first or second end of the lower member and the first or second end of the upper member to lock the two piece swivel joint in place, to prevent swiveling around the lateral axis, however still allowing for some flexing due to the flexible material nature of the swivel joint when the cleaning apparatus comes in contact with stationary objects to prevent breakage.

8. The floor cleaning apparatus in accordance with claim 6 wherein said either and/or upper or lower support members are made out of a flexible plastic material with memory.

9. The floor cleaning apparatus in accordance with claim 6 wherein said pin to lock swivel joint can be stored in a storage hole when normal swivel movement of the connector is required.

10. The floor cleaning apparatus in accordance with claim 6 wherein said either and/or upper or lower support members is made out of a elastomer plastic material.

11. The floor cleaning apparatus in accordance with claim 6 wherein said axial bore includes a cavity.

12. A swivel joint apparatus comprising:

a tool connected to a two piece unitary flexible shock absorbing unbreakable molded elastomeric swivel joint;

c. the tool has a top mounting surface with a support frame extending along the longitudinal axis of the head;

d. the two piece swivel joint comprises a lower support member and an upper support member, the lower support member has a first end and a second end, the first end of the lower support member comprises a unitary flexible transverse clamping section having an upper jaw and a lower jaw which forms an elastomeric hinge that is made from a compressible expandable elastomer material to allow sufficient force to encapsulate and retain the upper and lower jaws onto the support frame, the upper and lower jaws form a slotted opening which interconnects with a retaining cavity for receiving the support frame of the cleaning head, the lower jaw has a push lever integrally formed therewith, such that when the push lever is forced inwardly, the lower jaw is moved away from the upper jaw by way of the elastomeric hinge for allowing the support frame to be inserted through the slotted opening and secured within the retaining cavity when the push lever is released;

e. and the upper support member has a first end and a second end, the first end of the upper support member has a longitudinal attachment section having an axial bore with an open end to receive a longitudinal handle, the handle has one end press fitted from the open end and secured within the axis bore of the upper support member, the second ends of the lower support member and the upper support member are connected via a pivoting member forming a universal joint, to allow for rotation around a lateral axis, the upper and lower support members are made from an elastomeric flexible material so that when the cleaning apparatus comes in contact with stationary objects or is abused, the two piece unitary swivel joint will flex and prevent damage to the handle.

13. The swivel joint apparatus of claim 12 further comprising a shock absorbing sliding housing that encapsulates both the upper and lower support members to lock the two piece swivel joint in place, to prevent swiveling around the lateral axis, however still allowing for some flexing due to the flexible material nature of the swivel joint when the cleaning apparatus comes in contact with stationary objects.

14. The swivel joint apparatus of claim 12, wherein said upper and/or lower support members are indented and/or having flexible releasable extensions that engage in indented, notched and/or holes in slider housing that can be pressed inward to disengage sliding housing from either the locked and/or un locked swivel position therefore eliminating inadvertent movement of slider during operation of apparatus in either the locked or unlocked position.

15. The swivel joint apparatus of claim 12, wherein the upper and/or lower support members are made from an elastomeric flexible shock absorbing material which allows the upper and/or lower support member, between a flexible transverse clamping section and pivot point axis; lateral flexing of mid section approximately 3-75 degrees when the cleaning head apparatus comes in contact with stationary objects or is abused such that the shock absorbing mid section member prevents the handle member and or swivel attachment from breaking and thus instead absorbing damaging shocks to handle, attachment and/or cleaning head apparatuses.

16. The swivel joint apparatus of claim 12, further comprises a means to stop or interfere with the push lever and displace the cavity to stop the lower jaw to move forward in relation to the upper jaw, an axis shaft hole size for a shaft will be undersized and the flexible elastomer material that has expansion and compression properties can be adjusted via a threaded bolt and/or wing nut to adjust the amount of pre-load causing friction to eliminate wobble during a cleaning operation.

17. The swivel joint apparatus of claim 12, further comprising a protruding keyed support frame that is encapsulated by the upper and lower laws thus stopping rotation around the support frame.

* * * * *